US005899453A

United States Patent [19]

Middelberg et al.

[11] Patent Number: 5,899,453

[45] Date of Patent: May 4, 1999

[54] DOCUMENT COLLECTOR, DIVERTER AND STAGER APPARATUS AND METHOD

[75] Inventors: Neal J. Middelberg, Apex, N.C.; Keith A. Brown, Sr., Port St. Lucie, Fla.; Gregory T. Lucas, Huntington Beach, Calif.; Daniel C. Park, West Linn, Oreg.

[73] Assignee: Bell & Howell Mail Processing Systems, Durham, N.C.

[21] Appl. No.: 08/771,589

[22] Filed: Dec. 20, 1996

Related U.S. Application Data

[63] Continuation-in-part of application No. 08/734,718, Oct. 21, 1996.

[51] Int. Cl.[6] ..... B65H 29/62

[52] U.S. Cl. ..... 271/184; 271/303; 271/69; 414/790.3

[58] Field of Search ..... 271/300, 303, 271/69, 213, 298; 270/45, 58.06, 58.16, 58.29; 414/790.3, 790.7, 789.9; 198/731

[56] References Cited

U.S. PATENT DOCUMENTS

| | | | |
|---|---|---|---|
| 3,557,667 | 1/1971 | Molla | 271/213 |
| 4,006,831 | 2/1977 | Jimenez | 271/213 |
| 4,318,484 | 3/1982 | Stiernspetz | 271/184 |
| 4,950,398 | 8/1990 | Weigand et al. | 198/733 |
| 5,000,657 | 3/1991 | Gunther, Jr. | 414/790.3 |
| 5,006,040 | 4/1991 | Frey | 414/790.7 |
| 5,147,092 | 9/1992 | Driscoll et al. | 271/213 |
| 5,211,384 | 5/1993 | Orsinger et al. | 270/58.06 |
| 5,342,038 | 8/1994 | Suter | 414/790.7 |
| 5,405,240 | 4/1995 | Uno | 414/790.7 |

*Primary Examiner*—William E. Terrell
*Assistant Examiner*—Patrick Mackey
*Attorney, Agent, or Firm*—Jenkins & Wilson, P.A.

[57] ABSTRACT

A document collector, stager and diverter apparatus and method are provided for processing sheet articles through a first and second stage. The first stage is adapted for receiving sheet articles advanced thereto and collected therein and includes a first transport mechanism being operative for selectively diverting collected sheet articles in a divert direction opposite to the conveying direction of the sheet articles. Alternately, the first transport mechanism is operative for selectively advancing the collected sheet articles from the first stage to the second stage. In the second stage, sheet articles can be independently processed and held until a predetermined time when they can be advanced from the second stage by a second transport mechanism. The first and second transport mechanisms each preferably includes plastic chains each with plastic lugs thereon. The chains of the first and second transport mechanisms are simultaneously rotatably movable by a motor and gears or pulleys associated therewith.

26 Claims, 7 Drawing Sheets

DOCUMENT COLLECTOR, DIVERTER AND STAGER APPARATUS AND METHOD

CROSS REFERENCE TO RELATED APPLICATIONS

This application is a continuation-in-part application of application Ser. No. 08/734,718, filed Oct. 21, 1996, entitled DIVERTER APPARATUS AND METHOD.

TECHNICAL FIELD

The present invention relates generally to apparatuses and methods for processing documents such as sheet articles. More particularly, the present invention relates to an apparatus and method for collecting sheet articles, diverting or advancing the collected sheet articles and staging and further advancing the advanced sheet articles at a predetermined time.

BACKGROUND ART

A variety of sheet article processing apparatuses and methods exist in the art for processing sheet articles such as, for example, mail media comprising paper envelope inserts which are processed at high speeds. To insert such sheet articles into envelopes, the sheet articles, folded or unfolded are usually collected in a stack and conveyed in a conveying path to an envelope inserting machine which has a continuously moving transport chain with discrete time windows inside of which a successful delivery of a stack of sheet articles is possible. A stager mechanism is therefore necessary between the collector and the envelope inserting machine to correctly correlate proper delivery of the sheet articles to the envelope inserting machine within an appropriate time window thereof, and various types of stager apparatuses exist within the art of sheet processing as is apparent to those of skill in the art.

As is readily apparent to those of skill in the art of sheet processing, a need commonly exists for selectively diverting sheet articles from the conveying path during collection thereof subsequent to folding and prior to advancement of collected sheet articles to the envelope inserting machine so that the diverted sheet articles can be manually processed. In the past, sheet articles have been diverted from the conveying path by using a solenoid-driven ramp or gate to selectively divert sheet articles above or below the conveying path. This divert method requires two electronically controlled mechanisms which are the divert solenoid and the mechanism for transporting the sheet articles in the conveying path. This prior art method of diverting sheet articles can therefore be said to be "in-line" with the conveying path of the high-speed media processing apparatus. It is a requirement of this prior art method therefore that an additional component, i.e. a solenoid, be utilized and that the machine processing the media be long enough to accommodate the divert gate. The use of the divert gate also has the potential of slowing down the overall system performance due to the activation time required to open and close the gate.

For the actual conveying or transporting of sheet articles, it has in the past been common for high-speed media processing apparatuses to utilize a belt with one or more lugs or push members attached thereto for causing the sheet articles to be conveyed along a predetermined path. One apparatus used in the past utilizes a timing belt constructed of neoprene with screw-on lugs attached thereto to push or transport folded sheets of paper during high-speed media processing. An electro-magnetic clutch/brake combination is used to control the motion of the timing belt. As known to those of skill in the art of high-speed media processing, the motion of such a timing belt is typically slow, the timing belt breaks very frequently with continued use, and the clutch/brake system ultimately wears out. Such a timing belt is also usually very difficult to replace since it is a closed loop and typically requires some disassembly of the machine for replacement.

Another method used in the past for transporting collected sheet articles collects sheet articles over a moving belt, thus energizing a solenoid that moves a bracket stopping advancement of the sheet articles and simultaneously pushes a roller down on top of the sheet articles to advance the sheet articles past the bracket. This method has proven somewhat unreliable for advancing larger stacks of sheet articles, particularly at higher speeds, because of the tendency for the sheet articles to delaminate upon acceleration.

Additionally, metal chains with steel push pins or lugs have been used in media transport applications, but due to their inherent weight and the weight of the gears or sprockets used to drive them, they severely limit the speed at which media can be processed and reduce the ability to precisely control the motion of the media.

In light of the prior art apparatuses and methods for conveying and diverting media such as sheet articles in high-speed media processing, room for improvement exists in the art of sheet article processing for a document collector, diverter and stager apparatus and method for collecting sheet articles before or after they have been folded, selectively diverting the collected sheet articles from the conveying path or advancing the sheet articles to a stager, and selectively further advancing the sheet articles from the stager at a predetermined time to another location such as, for example, an envelope inserting machine.

SUMMARY OF THE INVENTION

In accordance with the present invention, a novel document collector, diverter and stager apparatus and method are provided utilizing at least a first and second stage. The first stage is adapted for receiving one or more sheet articles advanced thereto and collected therein and comprises a first transport mechanism. The first transport mechanism is operative for selectively diverting collected sheet articles in a divert direction opposite to the conveying direction of the sheet articles. Alternately, the first transport mechanism is operative for selectively advancing the collected sheet articles from the first stage to a second stage which acts as a stager or buffer for the advanced sheet articles. Once in the second stage, the sheet articles can be held until a predetermined time when they can be selectively further advanced from the second stage by a second transport mechanism.

The first and second transport mechanisms each preferably comprise one or more plastic chains each with a plurality of plastic lugs thereon. Each chain is rotatably movable by a motor and gears or pulleys associated therewith. The lugs of each chain are spacedly positioned on the chain and are adapted for engaging and conveying media encountered thereby. A step motor or closed-loop servomotor can be utilized to drive the chains, and the chains of at least the first stage can be selectively reversed from rotation in the conveying direction such that the chains rotate in a substantially opposite, divert direction and at least one of the lugs on each chain diverts and conveys media from the conveying direction in the opposite divert direction wherein the diverted media are passed to a divert chute and pass therethrough to a collecting bin.

It is therefore an object of the present invention to provide a novel document collector, diverter and stager apparatus and method particularly suitable for high-speed processing of sheet articles.

It is another object of the present invention to provide a document collector, diverter and stager apparatus and method for collecting sheet articles either before or after the sheet articles have been folded, selectively diverting collected sheet articles or advancing collected sheet articles, and selectively further advancing the sheet articles at a predetermined time.

It is a further object of the present invention to provide a document collector, diverter and stager apparatus and method adapted for diverting sheet articles utilizing the same mechanism that is utilized for conveying sheet articles along a conveying path.

It is a still further object of the present invention to provide a document collector, diverter and stager apparatus and method utilizing transport mechanisms which can be driven at high acceleration and speed with minimal wear and long life.

Some of the objects of the invention having been stated hereinabove, other objects will become evident as the description proceeds, when taken in connection with the accompanying drawings as best described hereinbelow.

DETAILED DESCRIPTION OF THE INVENTION

Figure 1:
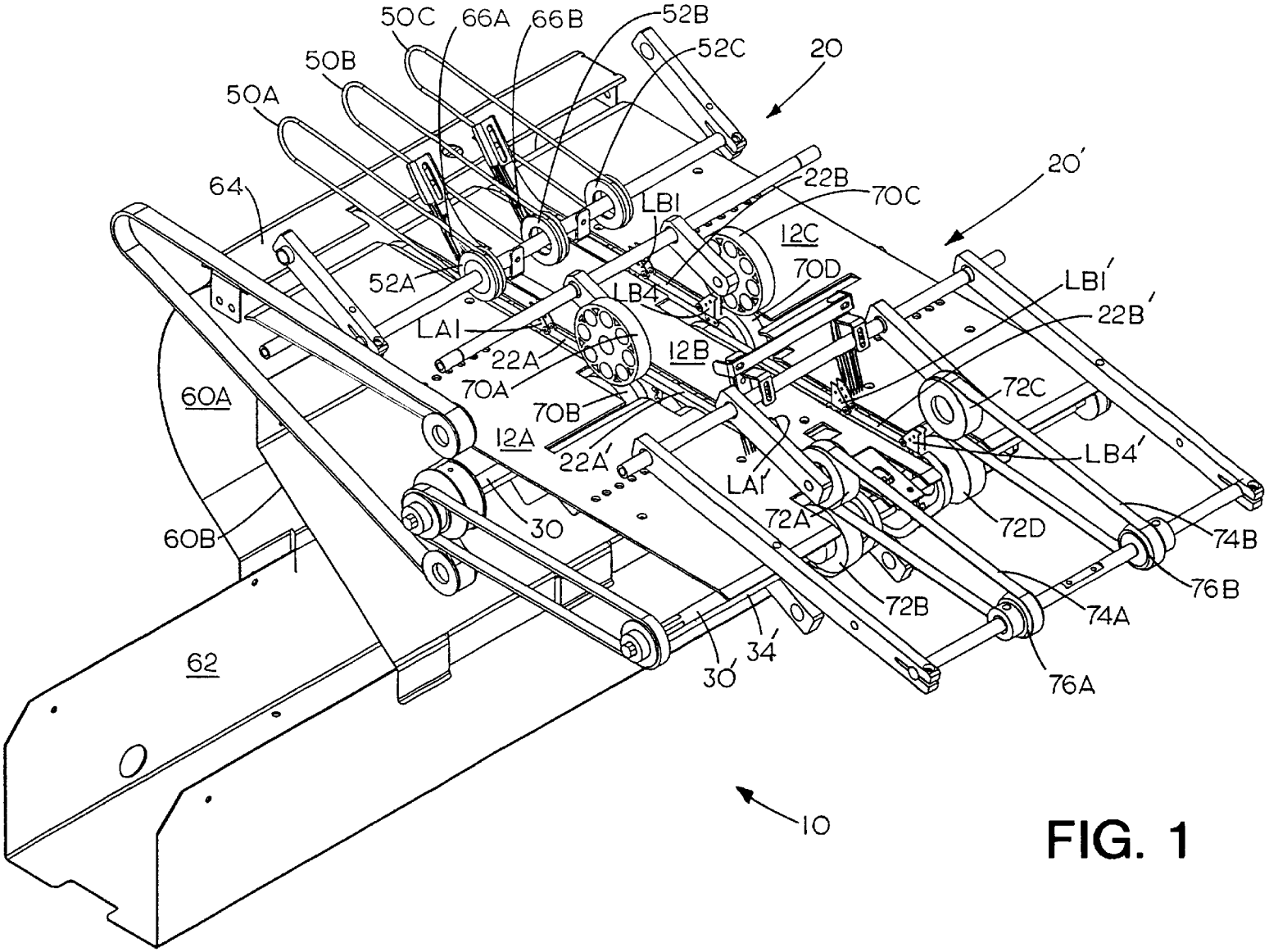
FIG. 1 of the drawings is a perspective view of a preferred embodiment of the collector, diverter and stager apparatus according to the present invention.

In accordance with the present invention, a novel document collector, diverter and stager apparatus generally designated 10 and method are provided which have particular use in high-speed media processing for collecting sheet articles, selectively diverting or advancing the collected sheet articles, and holding or staging the advanced sheet articles until a predetermined time when they are then selectively further advanced to exit apparatus 10. The sheet articles can be unfolded sheet articles or folded sheet articles each having a plurality of panels as will be apparent to those of skill in the art. Apparatus 10 is particularly adapted for collecting in a stack sheet articles fed seriatim in a single row or "one-up" relationship, and selectively diverting the stack or advancing the stack of sheet articles to a stager or buffer where the stack can be held until a predetermined time at which it is selectively further advanced. It can be appreciated in accordance with this invention, however, that apparatus 10 could be adapted for collecting and advancing sheet articles in other relationships, such as, for example, a "two-up" relationship. In a preferred embodiment, apparatus 10 is modular in design and can be operatively attached or connected in-line with a variety of suitable sheet article processing devices. For example, a folder machine can be attached upstream to apparatus 20 such that apparatus 10 processes folded sheet articles, and an envelope inserting machine can be attached downstream to apparatus 10 such that the folded sheet articles being advanced from apparatus 10 can be inserted into envelopes.

Apparatus 10 comprises a first stage generally designated 20 and a second stage generally designated 20' as best illustrated in FIGS. 1, 3 and 4A through 4D. Each stage 20 and 20' is adapted for receiving and independently processing sheet articles as described hereinbelow. Apparatus 10 includes support plates 12A, 12B and 12C which extend through first stage 20 and second stage 20' for supporting sheet articles processed therethrough. Support plates 12A, 12B and 12C extend within a horizontal plane for conveyance of sheet articles through apparatus 10, and support plates 22A, 12B and 12C are spacedly positioned whereby the lugs used to move sheet articles can extend therebetween.

First stage 20 and second stage 20' each comprise one or more transport mechanisms for suitably advancing sheet articles through apparatus 10 according to this invention. In a preferred embodiment, first stage 20 and second stage 20' include identical transport mechanisms as each comprises a pair of spaced-apart and parallel rotation members which are simultaneously and identically movable for conveying sheet articles.

Figure 2:
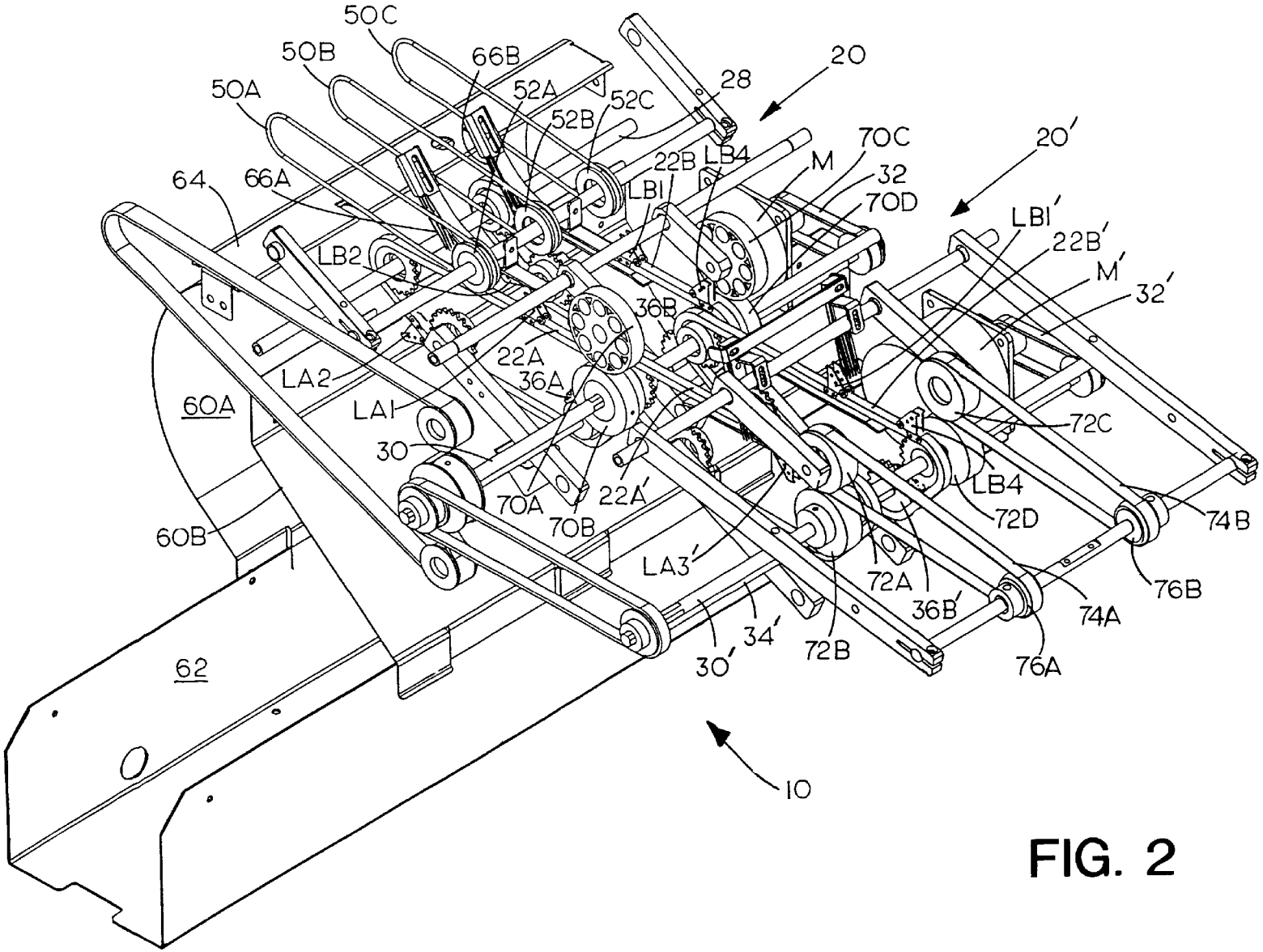
FIG. 2 of the drawings is a perspective view of the collector, diverter and stager apparatus shown in FIG. 1 with the support plates for supporting sheet articles removed therefrom.
Figure 3:
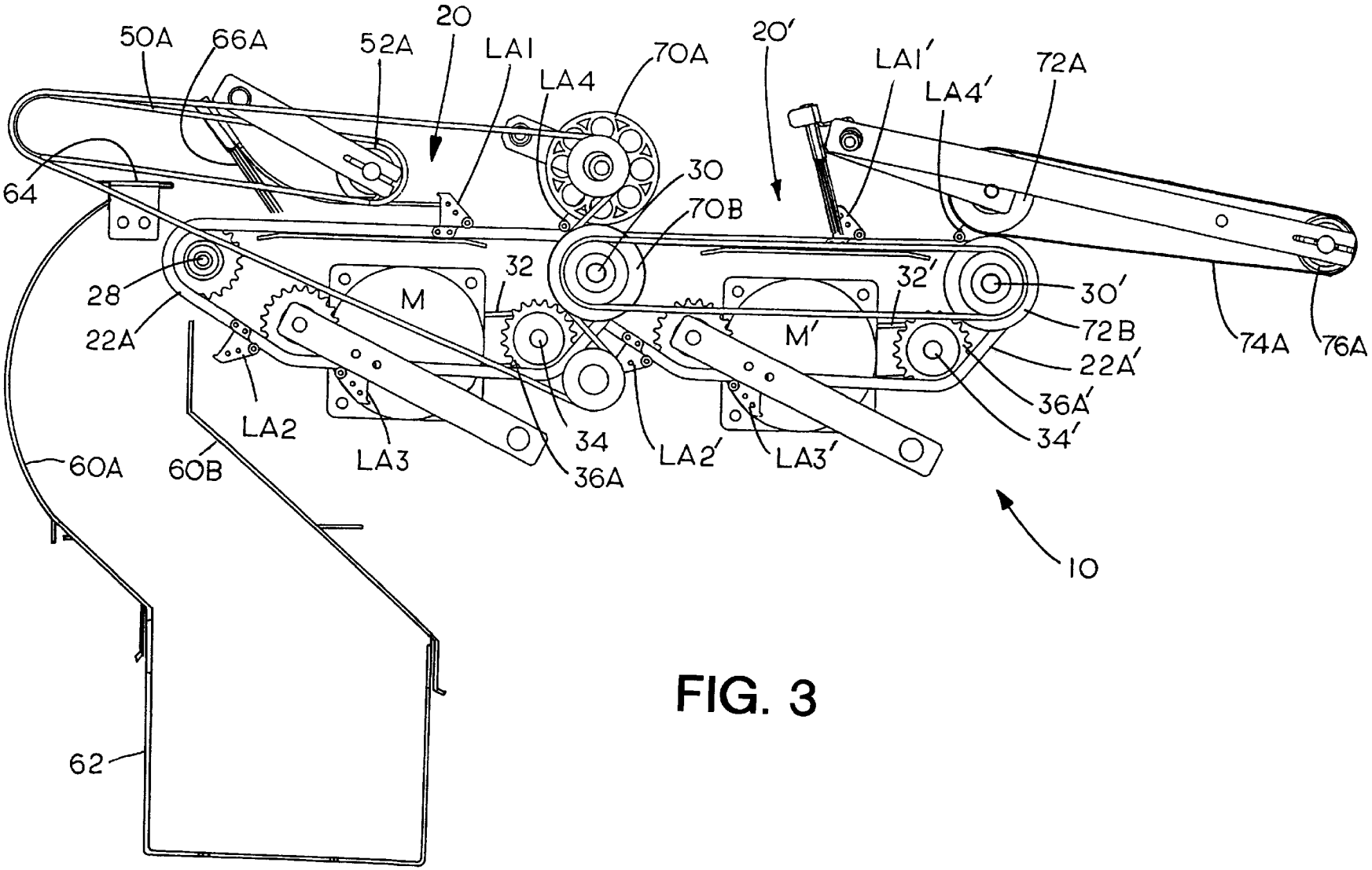
FIG. 3 of the drawings is a side elevational view of the collector, diverter and stager apparatus illustrated in FIG. 2.

As best illustrated in FIG. 2 of the drawings, first stage 20 includes rotation members 22A and 22B, and second stage 20' includes rotation members 22A' and 22B' wherein the rotation members of each stage can comprise any suitable rotation mechanism such as a belt or chain. In a preferred embodiment, rotation members 22A, 22B, 22A' and 22B' comprise plastic chains with plastic lugs attached thereto in accordance with the disclosure of co-pending application Ser. No. 08/731,725, entitled CHAIN APPARATUS FOR HIGH-SPEED MEDIA PROCESSING, filed on Oct. 21, 1996, commonly owned herewith and which is incorporated by reference herein. Rotation members 22A, 22B, and 22A', 22B' are preferably therefore endless plastic chains in a preferred embodiment with a plurality of plastic lugs attached thereto for engaging sheet articles. The materials of construction can be suitably selected for the rotation members to be able to be driven at high accelerations with minimal wear and long life, as disclosed in the commonly-owned pending application incorporated by reference herein and identified hereinabove. The lugs of each rotation member are adapted for engaging and conveying a stack sheet articles without delamination, and the lugs are preferably strategically spacedly positioned in accordance with the disclosure of the pending parent application identified hereinabove. Each rotation member therefore includes two pairs of lugs for engaging sheet articles from different directions. The lugs within each pair are spacedly positioned at halfway points on a rotation member such that a one-half cycle rotation of the rotation member causes one of the lugs of each pair to rotate to the former position of the other lug.

Specifically, and as at least partially illustrated in each of the various figures of drawings, rotation member 22A has lugs LA1, LA2, LA3 and LA4 attached thereto; rotation member 22B has lugs LB1, LB2, LB3 and LB4 attached thereto; rotation member 22A' has lugs LA1', LA2, LA3' and LA4' attached thereto; and rotation member 22B' has lugs LB1', LB2', LB3' and LB4' attached thereto. It is, however, envisioned according to this invention that the rotation members could be suitable belts, and that the lugs could be of any other design suitable for use in processing of sheet articles as described herein.

Rotation members 22A and 22B of first stage 20 are preferably of identical length and size and engage and extend around idler gears attached to shaft 28 at one end of first stage 20 and engage and extend around other idler gears attached to common shaft 30 at an opposite end of first stage 20. Rotation members 22A' and 22B' of second stage 20' are also preferably the same length and size as one another and engage and extend around other idler gears attached to common shaft 30 at one end of second stage 20' and engage and extend around other idler gears attached to shaft 30' at an opposite end of second stage 20'. In accordance with this invention, rotation members 22A and 22B are operable simultaneously with one another, as are rotation members 22A' and 22B', although each pair of rotation members can be rotated independently of the other pair such that sheet articles can be selectively processed independently by first stage 20 and second stage 20'. As such, motor M is utilized to simultaneously drive rotation members 22A and 22B by operative attachment of a drive belt 32 around shaft 34 which has gears 36A and 36B fixedly attached thereto for forcibly rotating rotation members 22A and 22B, respectively. Similarly, motor M' is utilized to drive rotation members 22A' and 22B' by operative attachment of drive belt 32' from motor M' around shaft 34' which has gears 36A' and 36B' fixedly attached thereto for forcibly rotating rotation members 22A' and 22B', respectively. Motors M and M' are preferably step motors in open-loop control, but can be other suitable motors such as closed-loop servo motors. In this manner, rotation members 22A, 22B and 22A', 22B' can be driven clockwise or counter-clockwise at high accelerations and high speeds with precise control. During processing of sheet articles in second stage 20 by apparatus 10, rotation members 22A' and 22B' likely will not ever need to rotate in the reverse, counter-clockwise direction. As will be recognized by those of skill in the art, tension rods with suitable idler gears thereon can be used to selectively maintain tension on rotation members 22A, 22B, 22A' and 22B', respectively.

At the feed end of apparatus 10 where sheet articles can be fed to apparatus 10, a plurality of upper O-rings 50A, 50B and 50C are positioned substantially above first stage 20 and are spaced-apart and movable so as to guide sheet articles to first stage 20. Also at the end where sheet articles can be fed into apparatus 10, apparatus 10 includes a divert chute defined by walls 60A and 60B for passage of diverted sheet articles and a divert bin 62 for collection of diverted sheet articles passing through the divert chute. A shelf 64 is positioned on top of the divert chute for supporting sheet articles advancing to first stage 20 so that the sheet articles can be accumulated on top of one another. Apparatus 10 further includes middle rollers 70A, 70B and 70C, 70D which operatively engage one another, respectively, wherein sheet articles can advance from first stage 20 to second stage 20'. Middle rollers 70C and 70D are positioned on common shaft 30. At the delivery end of apparatus 10, two other pairs of exit rollers 72A, 72B and 72C, 72D are positioned, respectively, and adapted for advancement of sheet articles between the rollers of each pair to exit apparatus 10. Exit rollers 72C and 72D are positioned on shaft 30'. Delivery belts 74A and 74B are operatively positioned around exit rollers 72A and 72C, passing between exit rollers 72A and 72B and exit rollers 72C and 72D, respectively. Delivery belts 74A and 74B also extend around end rollers 76A and 76B, respectively, such that delivery belts 74A and 74B can extend downstream from second stage 20 for assistance in delivering sheet articles exiting apparatus 10 to other suitable processing components.

In operation of apparatus 10, folded or unfolded sheet articles can be fed seriatim from an upstream sheet article processing component, such as a folding machine delivering folded sheet articles, to apparatus 10 between O-rings 50A, 50B and 50C and shelf 64 where the O-rings can guide and advance the sheet articles to first stage 20. The sheet articles advanced to first stage 20 can thereby be collected on top of one another in a stack with the stack of sheet articles being positioned in front end registration against a pair of lugs of rotation members 22A and 22B, such as lugs LA1 and LB1 which stop the sheet articles from further advancement in the conveying direction. Brushes 66A and 66B can be utilized above the sheet articles being fed to first stage 20 such that the sheet articles pass beneath brushes 66A and 66B where brushes 66A and 66B can prevent the advancing sheet articles from bouncing off lugs LA1 and LB2 and into the divert chute.

Once one or more sheet articles are collected in first stage 20, the collected sheet articles can then be selectively diverted from first stage 20 or selectively advanced from first stage 20 to second stage 20'. To divert the collected sheet articles, motor M causes rotation members 22A and 22B to suitably rotate counter-clockwise in a reverse, divert direction whereby lugs LA1 and LB1 force the collected sheet articles from first stage 20 into the divert chute to be collected in divert bin 62 as further discussed hereinbelow. The cycle of rotation of rotation members 22A and 22B in the divert direction stops with another pair of lugs, lugs LA3 and LB3 in position to stop other sheet articles subsequently advanced to first stage 20.

To advance the collected sheet articles from first stage 20 to second stage 20', motor M drives rotation members 22A and 22B to rotate clockwise in a forward, advance direction to cause another pair of lugs, lugs LA2 and LB2, to push and advance the collected sheet articles from first stage 20 between middle rollers 70A, 70B and 70C, 70D, respectively, and to second stage 20'. The rotation of rotation members 22A and 22B stops with another pair of lugs, lugs LA3 and LB3, in a position to stop subsequently advanced sheet articles. Once sheet articles reach middle rollers 70A, 70B, 70C and 70D, which are preferably continuously rotating by driving middle rollers 70B and 70D, the sheet articles are quickly advanced therebetween as the speed of middle rollers 70A, 70B, 70C and 70D is preferably such that the sheet articles are accelerated out of the way of the lugs used to advance the sheet articles before the lugs move in a downward direction by rotation of rotation members 22A and 22B.

Both the advance and divert rotation actions of rotation members 22A and 22B, as caused by motor M, preferably consist of movement equal to one-half of the length of each rotation member 22A and 22B which, along with the preferred spaced positioning of the lugs on each rotation member 22A and 22B, allow a lug of each rotation member 22A and 22B to always be in a position ready to receive the next sheet article at the end of either an advance or divert action. As will be apparent to those of skill in the art, the initial position of the lugs on rotation members 22A and 22B can be adjusted for accommodation of sheet articles of different lengths. In a preferred embodiment, the total length of rotation members 22A and 22B can be approximately twenty-three (23) inches, and rotation members 22A and 22B can process sheet articles as long as approximately six (6) inches and as short as three (3) inches after folding. It has been found that the advance action can be completed as fast as approximately 0.150 seconds, and that the divert action can be completed in approximately 0.200 seconds.

After advancing between middle rollers 70A, 70B, 70C and 70D, the sheet articles then enter second stage 20' where they are stopped in front end registration by a pair of lugs of rotation members 22A' and 22B'. Sheet articles in second stage 20' can be maintained or staged therein until a predetermined time when it is desirable to advance the sheet articles from second stage 20' to exit apparatus 10. The sheet articles in second stage 20' can therefore be selectively advanced therefrom by motor M' driving rotation members 22A' and 22B' to rotate clockwise in a forward, advance direction such that another pair of lugs of rotation members 22A' and 22B', lugs LA2' and LB2', simultaneously rotate around and engage and push the sheet articles from second stage 20' between exit rollers 72A, 72B and 72C, 72D, respectively, to exit apparatus 10.

In accordance with the present invention, rotation members 22A and 22B can selectively rotate independently of rotation members 22A' and 22B'. Such independent control therefore enables independent processing of sheet articles in first stage 20 and second stage 20'. As can readily be understood, sheet articles can therefore be collecting in a stack in first stage 20, be holding or staging in a stack that has already been collected in first stage 20, or even be being selectively diverted from first stage 20 while sheet articles in second stage 20' are being staged therein or are being advanced therefrom. As discussed hereinbelow, FIGS. 4A through 4D of the drawings are various illustrations providing, without limitation, examples of sheet articles being independently processed in first stage 20 and second stage 20' of apparatus 10.

Figure 4A:
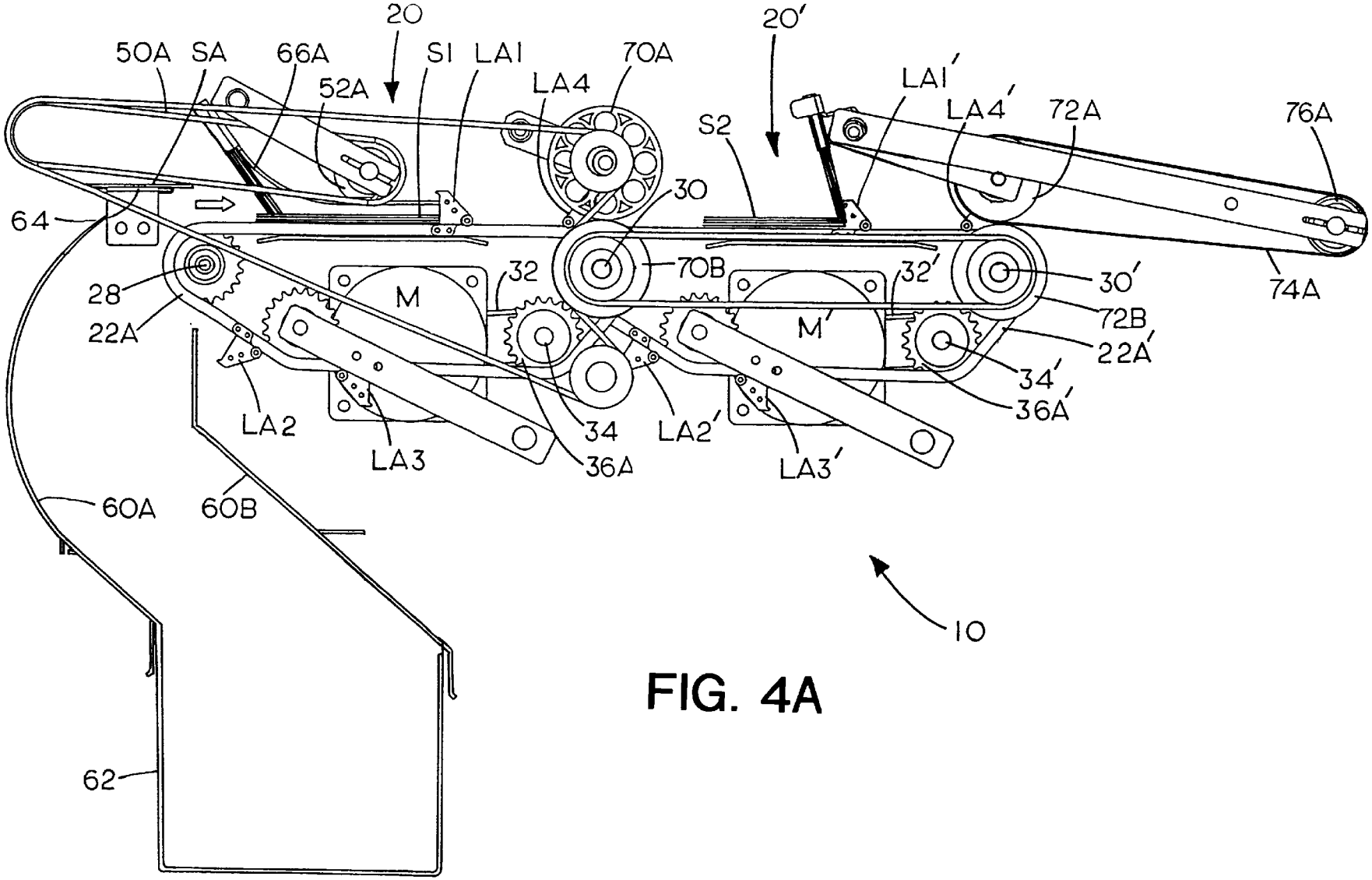
FIGS. 4A through 4D of the drawings are side elevational views of the collector, diverter and stager apparatus as shown in FIG. 3 illustrating various examples of sheet articles being processed therethrough according to the method of the present invention.

As shown in FIG. 4A of the drawings, sheet articles are being advanced to and collected in first stage 20 as sheet article SA is passing between O-rings 50A, 50B and 50C and shelf 64 toward stack S1 of sheet articles that have already been collected in first stage 20. The sheet articles in stack S1 are in front end registration against lugs LA1 and LB1 (not shown) of rotation members 22A and 22B (not shown). Simultaneously, another stack S2 of sheet articles is being maintained in second stage 20 in front end registration against lugs LA1' and LB1' (not shown) of rotation members 22A' and 22B' (not shown) as stack S2 can remain there until it is desirable to advance stack S2 therefrom.

Figure 4B:
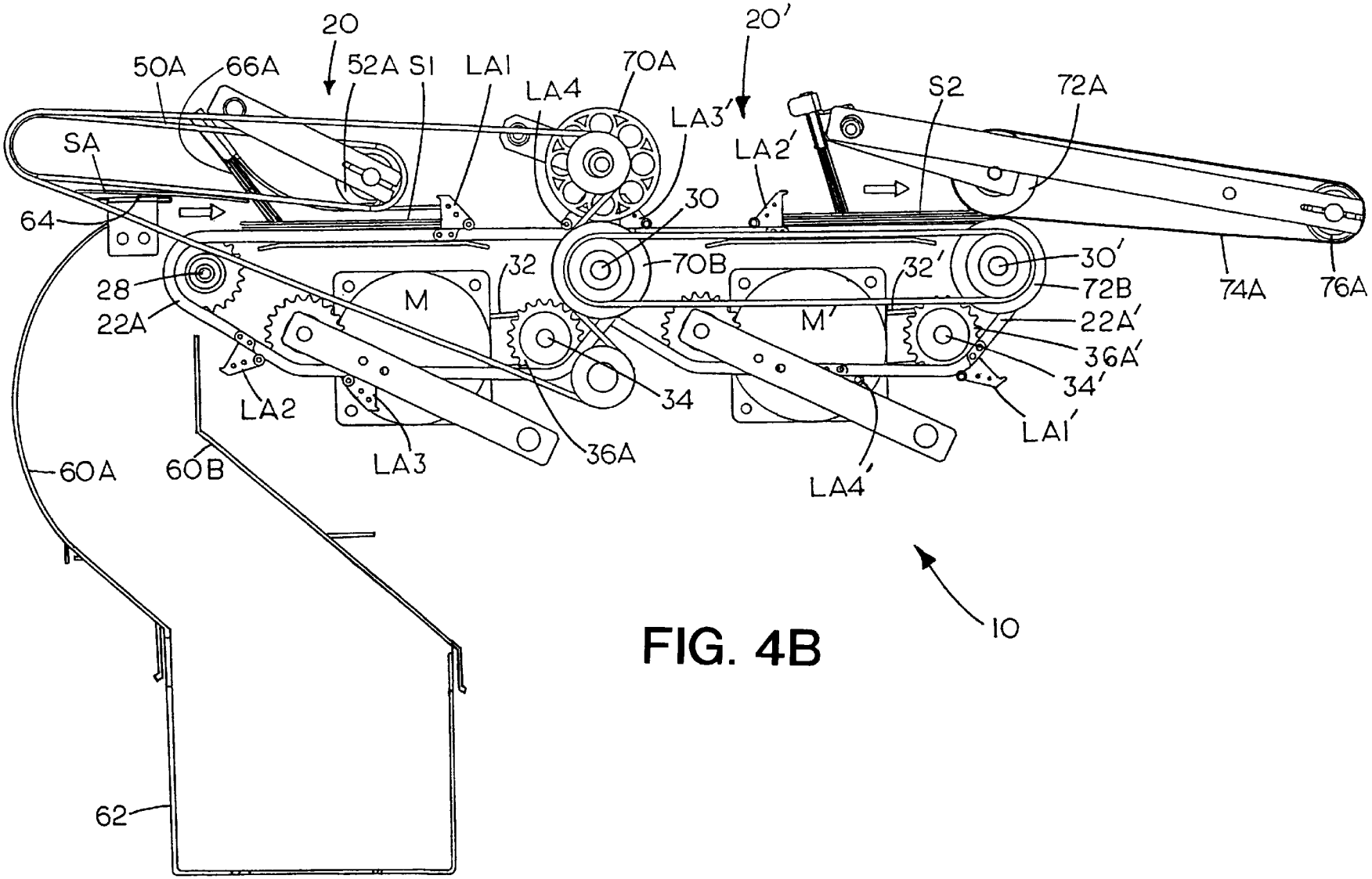

FIG. 4B of the drawings illustrates sheet article SA being advanced to stack S1 of sheet articles in first stage 20. Now, however, stack S2 of sheet articles in second stage 20' is being advanced from second stage 20' by clockwise rotation of lugs LA2' and LB2' (not shown) and rotation members 22A' and 22B' (not shown) in order for stack S2 to exit apparatus 10.

Figure 4C:
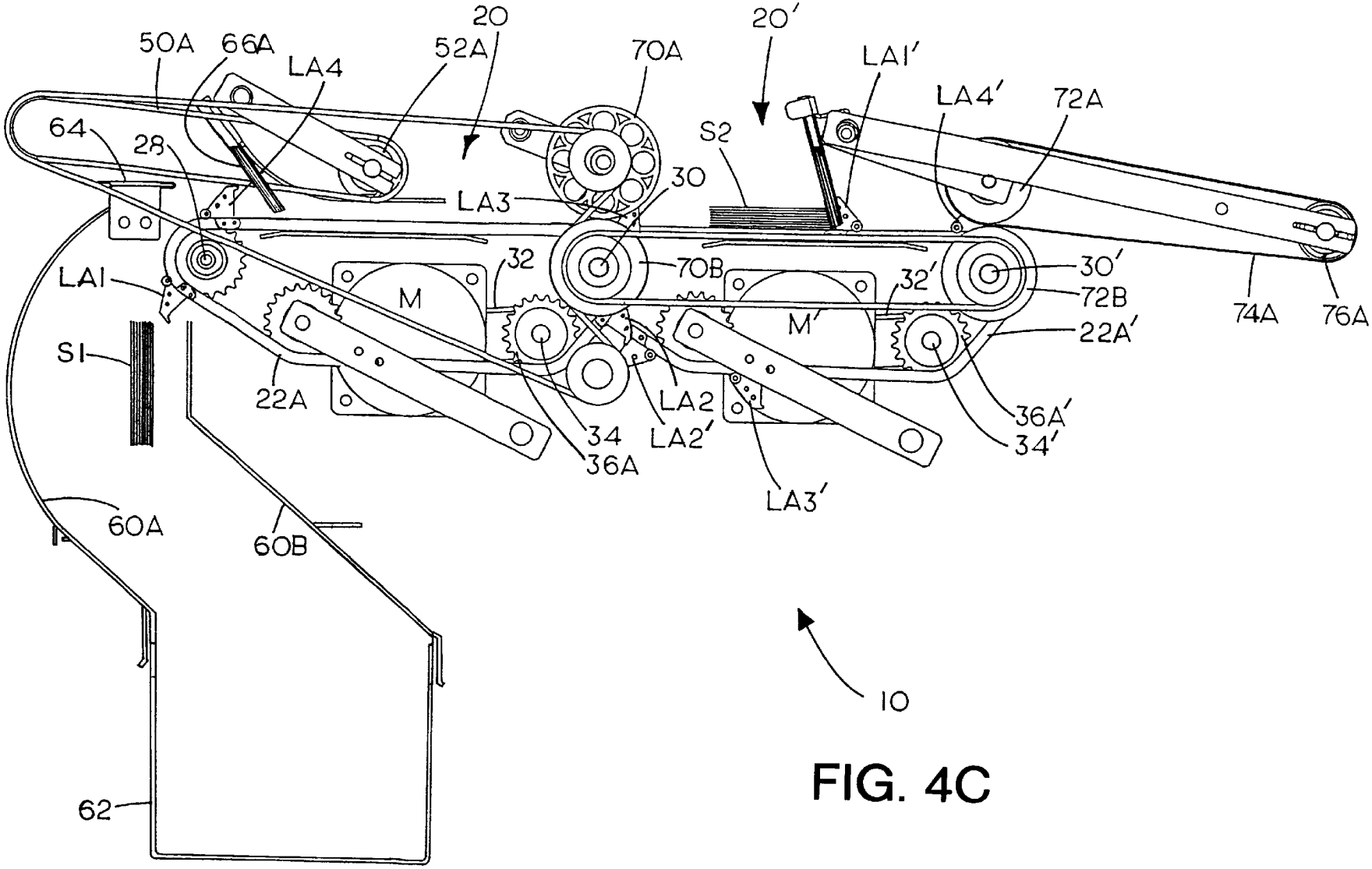

Referring now to FIG. 4C of the drawings, stack S1 of sheet articles formerly in first stage 20 is being diverted from first stage 20 into the divert chute to ultimately fall into and be collected in divert bin 62. Simultaneously, stack S2 of sheet articles is still being maintained in second stage 20' where it can remain until a predetermined time when it can be selectively advanced therefrom to exit apparatus 10.

Figure 4D:
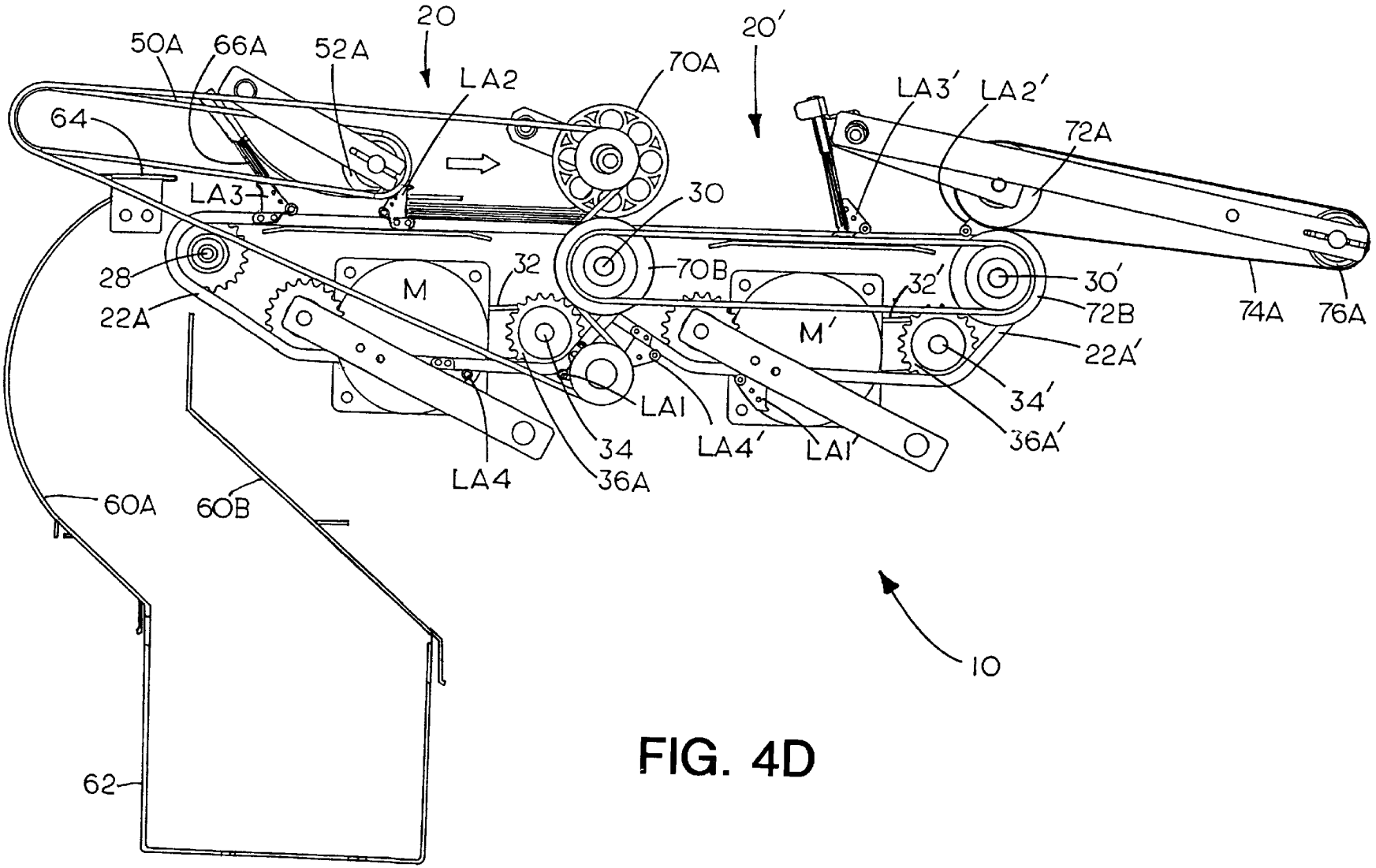

Referring now to FIG. 4D of the drawings, stack S1 of sheet articles in first stage 20 is being advanced therefrom by lugs LA2 and LB2 (not shown) of rotation members 22A and 22B (not shown), respectively. Simultaneously, there are no sheet articles in second stage 20', and second stage 20' is ready to receive stack S1 from first stage 20 with lugs LA3' and LB3' in position ready to receive and stop stack S1 in front end registration.

It is therefore seen that the present invention provides a novel document collector, diverter and stager apparatus and method, particularly for use in high-speed processing of sheet articles, for collecting sheet articles before or after folding, selectively diverting or advancing the sheet articles and staging the advanced sheet articles for selective further advancement at a predetermined time. It is also seen that the present invention provides a document collector, diverter and stager apparatus and method capable of diverting sheet articles utilizing the same mechanism that is utilized for conveying sheet articles along the conveying path. It can further be appreciated that the document collector, diverter and stager apparatus and method of the present invention utilize transport mechanisms which can be driven at high acceleration and speed with minimal wear and long life.

It will be understood that various details of the invention may be changed without departing from the scope of the invention. Furthermore, the foregoing description is for the purpose of illustration only, and not for the purpose of limitation as the invention is defined by the following, appended claims.

What is claimed is:

1. A collector, diverter and stager apparatus with at least a first and second stage for collecting and selectively diverting or advancing collected sheet articles and staging and further advancing the advanced sheet articles, said apparatus comprising:

(a) a first stage for collecting one or more sheet articles advanced thereto, said first stage comprising at least one rotation member including at least one movable lug on said rotation member for engaging sheet articles, said rotation member operative for said at least one lug to selectively divert the collected sheet articles from said first stage or selectively advance the collected sheet articles from said first stage to a second stage by rotation of said rotation member of said first stage; and (b) said second stage being substantially co-planar with said first stage and said second stage comprising at least one rotation member including at least one movable lug on said rotation member for engaging sheet articles, said second transport mechanism being operative for said lug of said second stage to selectively advance sheet articles from said second stage by rotation of said rotation member of said second stage.

2. The apparatus of claim 1 wherein said rotation members of said first and second stages each comprise one or more plastic chains.

3. The apparatus of claim 2 wherein said lugs of said rotation members of said first and second stages are plastic lugs.

4. The apparatus of claim 2 wherein said rotation members of said first and second stages comprise independently controllable motors for driving said plastic chains.

5. The apparatus of claim 4 wherein said motors are step motors.

6. A collector, diverter and stager apparatus with at least a first and second stage for collecting sheet articles and selectively diverting or advancing collected sheet articles for further staging and advancement, said apparatus comprising:

(a) a first and second stage for collecting one or more sheet articles advanced thereto in a conveying direction, said first and second stage each comprising a plurality of spaced-apart plastic lugs attached thereto for engaging sheet articles;

(b) a first set of said lugs of said first stage being selectively operative to simultaneously stop sheet articles collected in said first stage from further advancement in the conveying direction and subsequently either simultaneously divert the collected sheet articles from said first stage in a direction opposite to the conveying direction or alternately simultaneously advance the collected sheet articles in the conveying direction so as to no longer stop further advancement of the collected sheet articles in the conveying direction;

(c) a second set of said lugs of said first stage being operative for selectively simultaneously advancing the collected sheet articles to said second stage; and (d) a set of said lugs of said second stage being selectively operative to stop sheet articles advanced to said second stage and to advance sheet articles from said second stage by simultaneous movement of said chains of said second stage.

7. The apparatus of claim 6 wherein separate drive motors are used to move said chains of said first and second stages.

8. The apparatus of claim 7 wherein said drive motors are step motors.

9. A method of collecting sheet articles and selectively diverting or advancing the collected sheet articles and further advancing the advanced sheet articles, said method comprising the steps of:

(a) advancing one or more sheet articles to and collecting the sheet articles in a first stage;

(b) selectively advancing the collected sheet articles in a conveying direction from said first stage to a second stage substantially co-planar with said first stage or alternately diverting the collected sheet articles from said first stage in a direction at least generally opposite to the conveying direction by movement of at least one lug of at least one rotation member of said first stage caused by rotation of said rotation member to move said at least one lug in the conveying direction or in the direction generally opposite to the conveying direction;

(c) maintaining the sheet articles advanced to said second stage thereon; and (d) advancing the sheet articles from said second stage in the conveying direction by movement of at least one lug of at least one rotation member of said second stage caused by rotation of said rotation member of said second stage to move said at least one lug of said rotation member of said second stage in the conveying direction.

10. The method of claim 9 wherein the sheet articles are advanced seriatim to said first stage and collected in a stack.

11. The method of claim 10 wherein the stack of sheet articles collected in said first stage is selectively diverted therefrom or advanced to said second stage.

12. The method of claim 11 wherein the sheet articles are advanced from said second stage as a stack.

13. The method of claim 9 wherein sheet articles are collected and maintained in front end registration in said first stage by a lug of said rotation member of said first stage stopping sheet articles collected in said first stage.

14. The method of claim 9 wherein the sheet articles maintained in said second stage are maintained in front end registration by a lug of said rotation member of said second stage stopping sheet articles advanced to said second stage.

15. The method of claim 9 wherein said rotation members of said first and second stages are operated independently such that sheet articles can be collected in or diverted from said first stage simultaneously with sheet articles being maintained in or advanced from said second stage.

16. A method of collecting sheet articles and selectively diverting or advancing the collected sheet articles and further advancing the advanced sheet articles, said method comprising the steps of:

(a) advancing sheet articles seriatim to a first stage;

(b) collecting the sheet articles in a stack in said first stage in front end registration;

(c) selectively advancing the collected sheet articles in a conveying direction from said first stage to a second stage substantially co-planar with said first stage or alternately diverting the collected sheet articles from said first stage in a direction at least generally opposite to the conveying direction by movement of plastic lugs attached to at least one plastic chain of said first stage;

(d) maintaining the sheet articles advanced to said second stage thereon in front end registration by at least a portion of plastic lugs of said second stage; and (e) advancing the sheet articles from said second stage in a conveying direction by at least a portion of said lugs of said second stage.

17. The method of claim 16 wherein sheet articles are collected in or diverted from said first stage simultaneously with sheet articles being maintained in or advanced from said second stage.

18. The method of claim 9 further comprising the step of adjusting a position of said lug of said rotation member of said first stage by rotation of said rotation member of said first stage to allow said first stage to accommodate a length of said one or more sheet articles prior to the step of paragraph (a).

19. A method of collecting sheet articles of various lengths in a stage and advancing collected sheet articles at high speed from said stage, said method comprising the steps of:

(a) advancing one or more first sheet articles of a first predetermined length to and collecting said first sheet articles in a stage against a first lug of a motor-driven transport mechanism wherein said first lug is in a position allowing said stage to accommodate said first predetermined length of said first sheet articles;

(b) advancing said first sheet articles from said stage at high speed;

(c) subsequent to the step of paragraph (b), adjusting said transport mechanism by operation of said motor such that a second lug of said transport mechanism is in a position allowing said stage to accommodate one or more second sheet articles of a second predetermined length; and (d) advancing said second sheet articles of said second predetermined length to and collecting said second sheet articles in said stage against said second lug of said transport mechanism.

20. A collector, diverter and stager apparatus with at least a first and second stage for collecting sheet articles and selectively diverting or advancing collected sheet articles and staging and further advancing the advanced sheet articles, said apparatus comprising:

(a) a first stage for collecting one or more sheet articles advanced thereto, said first stage comprising a first transport mechanism including at least one movable lug for engaging sheet articles, said first transport mechanism being operative for said at least one lug to selectively divert the collected sheet articles from said first stage or selectively advance the collected sheet articles from said first stage to a second stage;

(b) said second stage comprising a second transport mechanism including at least one movable lug for engaging sheet articles, said second transport mechanism being operative for selectively advancing sheet articles from said second stage;

(c) whereby one or more sheet articles can be collected in said first stage where a lug of said first transport mechanism can selectively divert the collected sheet articles from said first stage or a lug of said first transport mechanism can selectively advance the collected sheet articles to said second stage, and whereby a lug of said second transport mechanism can selectively advance the sheet articles from said second stage at a predetermined time; and (d) wherein said first and second transport mechanisms each have a plurality of spaced-apart lugs, and said first and second transport mechanisms are operative for at least one of said lugs of each of said first and second transport mechanisms to simultaneously stop sheet articles advanced to said first and second transport mechanisms and for at least another of said lugs of each of said first and second transport mechanisms to subsequently simultaneously advance the previously stopped sheet articles from said first and second stages, respectively.

21. A collector, diverter and stager apparatus with at least a first and second stage for collecting sheet articles and selectively diverting or advancing collected sheet articles and staging and further advancing the advanced sheet articles, said apparatus comprising:

(a) a first stage for collecting one or more sheet articles advanced thereto, said first stage comprising a first transport mechanism including at least one movable lug for engaging sheet articles, said first transport mechanism being operative for said at least one lug to selectively divert the collected sheet articles from said first stage or selectively advance the collected sheet articles from said first stage to a second stage;

(b) said second stage comprising a second transport mechanism including at least one movable lug for engaging sheet articles, said second transport mechanism being operative for selectively advancing sheet articles from said second stage;

(c) whereby one or more sheet articles can be collected in said first stage where a lug of said first transport mechanism can selectively divert the collected sheet articles from said first stage or a lug of said first transport mechanism can selectively advance the collected sheet articles to said second stage, and whereby a lug of said second transport mechanism can selectively advance the sheet articles from said second stage at a predetermined time;

(d) wherein said first and second transport mechanisms each have a plurality of spaced-apart lugs, and said first and second transport mechanisms are operative for at least one of said lugs of each of said first and second transport mechanisms to simultaneously stop sheet materials advanced to said first and second transport mechanisms and for at least another of said lugs of each of said first and second transport mechanisms to subsequently simultaneously advance the previously stopped sheet articles from said first and second stages, respectively; and (e) wherein said at least one lug of each of said first and second transport mechanisms adapted for stopping the sheet articles is adapted for stopping the sheet articles in front end registration.

22. A collector, diverter and stager apparatus with at least a first and second stage for collecting sheet articles and selectively diverting or advancing collected sheet articles and staging and further advancing the advanced sheet articles, said apparatus comprising:

(a) a first stage for collecting one or more sheet articles advanced thereto, said first stage comprising a first transport mechanism including at least one movable lug for engaging sheet articles, said first transport mechanism being operative for said at least one lug to selectively divert the collected sheet articles from said first stage or selectively advance the collected sheet articles for said first stage to a second stage;

(b) said second stage comprising a second transport mechanism including at least one movable lug for engaging sheet articles, said second transport mechanism being operative for selectively advancing sheet articles from said second stage;

(c) whereby one or more sheet articles can be collected in said first stage where a lug of said first transport mechanism can selectively divert the collected sheet articles from said first stage or a lug of said first transport mechanism can selectively advance the collected sheet articles to said second stage, and whereby a lug of said second transport mechanism can selectively advance the sheet articles from said second stage at a predetermined time;

(d) wherein said first and second transport mechanisms each have a plurality of spaced-apart lugs, and said first and second transport mechanisms are operative for at least one of said lugs of each of said first and second transport mechanisms to simultaneously stop sheet materials advanced to said first and second transport mechanisms and for at least another of said lugs of each of said first and second transport mechanisms to subsequently simultaneously advance the previously stopped sheet articles from said first and second stages, respectively; and (e) wherein each of said first and second transport mechanisms comprises at least a pair of spaced-apart plastic chains to which said lugs are attached.

23. A method of collecting sheet articles and selectively diverting or advancing the collected sheet articles and further advancing the advanced sheet articles, said method comprising the steps of:

(a) advancing one or more sheet articles to and collecting the sheet articles in a first stage;

(b) using a first transport mechanism to selectively advance the collected sheet articles in a conveying direction from said first stage to a second stage or alternately divert the collected sheet articles from said first stage in a direction at least generally opposite to the conveying direction;

(c) maintaining the sheet articles advanced to said second stage thereon;

(d) advancing the sheet articles from said second stage in the conveying direction by a second transport mechanism at a predetermined time;

(e) wherein said first transport mechanism comprises at least one lug for engaging sheet articles and further comprising the step of adjusting a position of said lug to allow said first stage to accommodate a length of said one or more sheet articles prior to the step of paragraph (a); and (f) wherein said first transport mechanism further comprises a motor operatively connected to and for moving said lug, and wherein said adjusting of position of said lug comprises operating said motor to adjust position of said lug.

24. A collector, diverter and stager apparatus with at least a first and second stage for collecting and selectively diverting or advancing collected sheet articles and staging and further advancing the advanced sheet articles, said apparatus comprising:

(a) a first stage for receiving and collecting sheet articles;

(b) at least one first stage rotation member having a plurality of push lugs for engaging sheet articles, said push lugs being spaced-apart and positioned for at least one of said push lugs to stop sheet articles collected on said first stage in front end registration;

(c) a second stage for receiving sheet articles;

(d) said first stage rotation member being operative for selective rotation to move its push lugs thereon such that sheet articles collected on said first stage are selectively diverted in a divert direction from said first stage or alternately advanced from said first stage in a conveying direction to said second stage;

(e) at least one second stage rotation member having a plurality of push lugs for engaging sheet articles, said second stage rotation member push lugs being spaced-apart and positioned such that at least one of its push lugs to stop sheet articles advanced to said second stage in front end registration; and (f) said second stage rotation member being operative for selective rotation to move its push lugs thereon such that sheet articles on said second stage are advanced from said second stage in the conveying direction.

25. A method of collecting sheet articles and selectively diverting or advancing the collected sheet articles and further advancing the advanced sheet articles, said method comprising the steps of:

(a) advancing a plurality of sheet articles seriatim to a first stage where said sheet articles are collected in a stack and stopped in front end registration by a first push lug attached to a first stage rotation member;

(b) selectively rotating said first stage rotation member such that said first push lug of said first stage rotation member pushes and diverts said stack of sheet articles from said first stage in a divert direction or alternately such that a second push lug attached to said first stage rotation member pushes and advances said stack of sheet articles from said first stage in a conveying direction to a second stage;

(c) receiving and stopping said stack of sheet articles advanced from said first stage in front end registration in said second stage by a first push lug attached to a second stage rotation member; and (d) advancing said stack of sheet articles from said second stage in the conveying direction by selective rotation of said second stage rotation member such that a second push of said second stage rotation member pushes and advances said stack of sheet articles from said second stage.

26. A collector, diverter and stager apparatus with at least a first and second stage for collecting and selectively diverting or advancing collected sheet articles and staging and further advancing the advanced sheet articles, said apparatus comprising:

(a) a first stage for receiving and collecting sheet articles;

(b) at least one first stage rotation member having a plurality of push lugs for engaging sheet articles, said push lugs being spaced-apart and positioned for at least one of said push lugs to stop sheet articles collected on said first stage in front end registration;

(c) a second stage for receiving sheet articles;

(d) said first stage rotation member being operative for selective rotation to move its push lugs thereon such that sheet articles collected on said first stage are selectively diverted in a divert direction from said first stage or alternatively advanced from said first stage in a conveying direction to said second stage;

(e) at least one second stage rotation member having a plurality of push lugs for engaging sheet articles, said second stage rotation member push lugs being spaced-apart and positioned for at least one of its push lugs to stop sheet articles advanced to said second stage in front end registration; and (f) said second stage rotation member being operative for selective rotation to move its push lugs thereon such that sheet articles on said second stage are advanced from said second stage in the conveying direction and alternately for said second stage rotation member to move its lugs thereon in the divert direction.

* * * * *